US009360791B2

(12) United States Patent
Oyama

(10) Patent No.: US 9,360,791 B2
(45) Date of Patent: Jun. 7, 2016

(54) IMAGE FORMING APPARATUS USING A CLOCK SIGNAL GENERATED BY A SPREAD SPECTRUM CLOCK OSCILLATOR, AND A CONTROLLING METHOD THEREOF

(71) Applicant: CANON KABUSHIKI KAISHA, Tokyo (JP)

(72) Inventor: Naoki Oyama, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/505,229

(22) Filed: Oct. 2, 2014

(65) Prior Publication Data

US 2015/0103129 A1 Apr. 16, 2015

(30) Foreign Application Priority Data

Oct. 11, 2013 (JP) ..... 2013-214137

(51) Int. Cl.
*B41J 2/435* (2006.01)
*B41J 2/385* (2006.01)
*G03G 15/043* (2006.01)

(52) U.S. Cl.
CPC ..... *G03G 15/043* (2013.01)

(58) Field of Classification Search
CPC . G11B 7/0045; G11B 7/00456; G03G 15/043
USPC ..... 347/255, 224, 248, 237, 118; 358/3.06
See application file for complete search history.

(56) References Cited

U.S. PATENT DOCUMENTS

| | | | | |
|---|---|---|---|---|
| 5,379,126 | A * | 1/1995 | Seto et al. | 358/3.06 |
| 6,144,817 | A | 11/2000 | Takeuchi et al. | 399/51 |
| 6,147,699 | A * | 11/2000 | Berry et al. | 347/255 |
| 2012/0147119 | A1 * | 6/2012 | Toyoizumi et al. | 347/224 |
| 2014/0247317 | A1 * | 9/2014 | Kawamura | 347/248 |

FOREIGN PATENT DOCUMENTS

| | | |
|---|---|---|
| JP | 2003-312050 | 11/2003 |
| JP | 3684089 B | 8/2005 |
| JP | 2012-137743 | 7/2012 |

* cited by examiner

*Primary Examiner* — Julian Huffman
*Assistant Examiner* — Carlos A Martinez
(74) *Attorney, Agent, or Firm* — Fitzpatrick, Cella, Harper & Scinto

(57) ABSTRACT

An image forming apparatus outputs a clock signal used for outputting image data, outputs first image data in accordance with the outputted clock signal, outputs second image data in accordance with a clock signal for which the output clock signal is caused to change by a spread spectrum clock oscillator circuit, calculates a logical OR of the two outputs, and outputs image data, which is the calculation result, to an image forming unit. A laser device provided in the image forming unit is controlled in accordance with the outputted image data.

11 Claims, 14 Drawing Sheets

IMAGE FORMING APPARATUS USING A CLOCK SIGNAL GENERATED BY A SPREAD SPECTRUM CLOCK OSCILLATOR, AND A CONTROLLING METHOD THEREOF

BACKGROUND OF THE INVENTION

1. Field of the Invention

The present invention relates to an image forming apparatus that controls stabilization of an amount of light upon a microscopic light emission in a non-image area, a method of controlling the same, and an image output circuit.

2. Description of the Related Art

In color image forming apparatuses, a so-called white gap phenomenon, in which a white gap that should not be there is formed between images formed adjacently in differing colors, is known. This phenomenon occurs due to an electrostatic latent image, for example an image edge portion, for which a drum surface potential changes sharply, being formed on a photosensitive drum, and a developed image being formed more thinly than it otherwise would be when this portion is developed with a developing apparatus. For example, in an image in which a cyan color band and a black color band are adjacent, the cyan color band and the black color band should be adjacent, but because the developed image of each is respectively formed thinly, a gap between the cyan color and the black color in a final image on a recording material is formed.

It is known that when a microscopic light emission of a light-emitting element of a laser scanner is performed, to an extent that a toner adhesion does not occur, for a non-image area (a non-toner-image-forming-portion) within a full area of a printable region, a thinning of the image is prevented. Hereinafter, performing a microscopic light emission for a non-image area will be referred to as a background exposure, or as a microscopic light emission in a non-image area. In Japanese Patent No. 3684089, a technique for suppressing a situation in which, due to an aerial discharge occurring when transferring a region in which an image does not exist to a transfer medium, an image of another color deteriorates is proposed. In Japanese Patent Laid-Open No. 2003-312050, a technique for reducing unnecessary radiation, occurring when a background exposure is performed, is proposed. In Japanese Patent Laid-Open No. 2012-137743, a technique for stabilizing an amount of light upon a non-image area microscopic light emission is proposed.

However, there are problems in the above described conventional techniques as is described below. For example, in conventional techniques, techniques for reducing unnecessary radiation in a background exposure scheme have been proposed, but these approaches cannot be used for print methods that control a laser directly from a controller unit for generating an image for a printer. In recent years, amongst printer controllers, similarly to personal computers, frequencies that are controlled are being improved in order to improve image processing, network processing, and to improve printer speeds.

For this reason, in the personal computers and printer controllers, in recent years, in order to solve unnecessary radiation problems, a technology known as SSCG has come to be employed commonly. An SSCG (Spread Spectrum Clock Generator) is a semiconductor technology employed as a counter-measure to emitted electromagnetic noise (unnecessary radiation) of an electronic device.

Generally, an electronic device including a color image forming apparatus cannot be put on the market if it does not clear a regulation pertaining to unnecessary radiation. In the Japanese VCCI standard, there are categories of CLASS A and CLASS B, and because CLASS B is for products for which there is a possibility of installation in a family home, it is stricter as a standard, and for example, it is necessary to meet this standard for SFPs. With such unnecessary radiation regulations, tolerances are laid down for each frequency, and the standard is not satisfied if these tolerances are exceeded even by a small amount. An SSCG is an unnecessary radiation counter-measure technology that takes advantage of a characteristic of unnecessary radiation for a target peak value. More specifically, a peak value of unnecessary radiation due to a clock signal, or of unnecessary radiation due to a switching frequency of a device that operates with that clock signal as a basis, can be suppressed. However, because frequency is caused to fluctuate, the total energy quantity of the unnecessary radiation does not change.

However, in a color image forming apparatus, SSCG technology cannot be used for a clock of a circuit for outputting an image directly from a controller to a laser. This is because an output image is distorted since a modulation subtly occurs on a width of the image with respect to a defined width, and it is common to use a clock that does not use an SSCG for an image output signal of an image forming apparatus that performs direct laser control. In this way, there is the problem that, because an SSCG clock cannot be used when performing a background exposure, unnecessary radiation problems cannot be solved, and so devices cannot be put onto the market.

SUMMARY OF THE INVENTION

The present invention enables realization of an arrangement for reducing unnecessary radiation while performing a background exposure in an image forming apparatus that performs direct laser control.

One aspect of the present invention provides an image forming apparatus, comprising: a clock output circuit configured to output a clock signal which is used for outputting image data; a first image output circuit configured to output first image data in accordance with the outputted clock signal; a second image output circuit configured to output second image data in accordance with a clock signal which is generated from the outputted clock signal by a spread spectrum clock oscillator circuit; and an OR circuit configured to calculate a logical OR of the output of the first image output circuit and the output of the second image output circuit, and to output, to an image forming unit, image data which is the calculation result, wherein a laser device provided in the image forming unit is controlled in accordance with the image data output from the OR circuit.

Another aspect of the present invention provides an image output circuit for processing and outputting input image data, the image output circuit comprising: a first image output circuit configured to output normal image data in accordance with the a clock signal for outputting an image; a second image output circuit configured to output image data for a microscopic light emission in accordance with a clock signal for which the clock signal is caused to change by a spread spectrum clock oscillator circuit; and an OR circuit configured to calculate a logical OR of the output of the first image output circuit and the output of the second image output circuit, and to output the calculation result.

Still another aspect of the present invention provides a method of controlling an image forming apparatus, the method comprising: a clock output step of outputting a clock signal used for outputting image data; a first image output step of outputting first image data in accordance with the outputted clock signal; a second image output step of outputting second image data in accordance with a clock signal for which the outputted clock signal is caused to change by a spread spectrum clock oscillator circuit; and an OR step of calculating a logical OR of the output in the first image output step and the output in the second image output step, and outputting image data, which is the calculation result, to an image forming unit, wherein a laser device provided in the image forming unit is controlled in accordance with the image data output in the OR step.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<Image Forming Apparatus Configuration>

Figure 1:
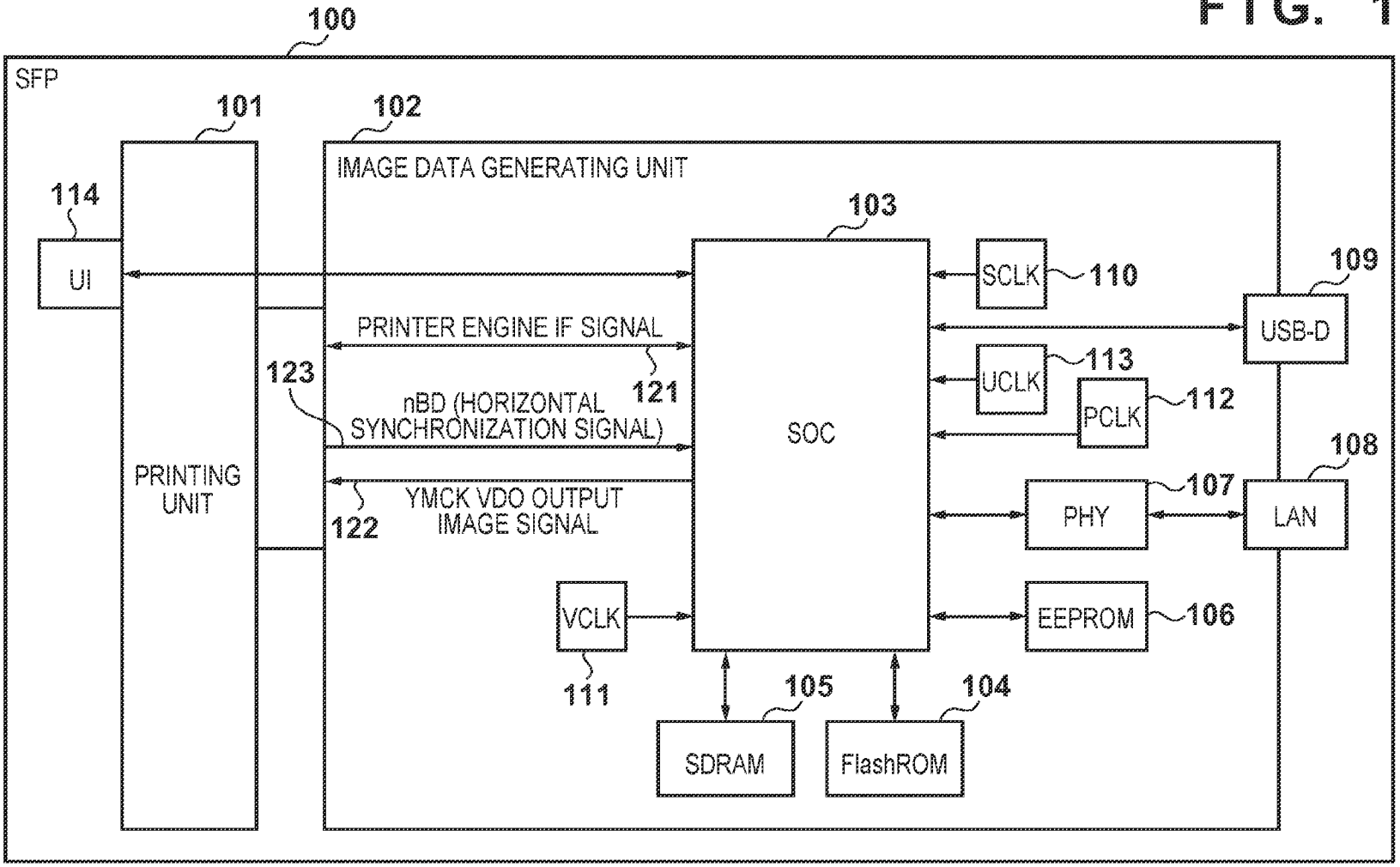
FIG. 1 is a view for showing a configuration of a single function printer according to an embodiment.

Below, explanation will be given for embodiments of the present invention with reference to FIG. 1 through FIG. 16. Firstly, with reference to FIG. 1, explanation will be given for a configuration of a single function printer (SFP) which is an image forming apparatus according to embodiments.

Reference numeral 100 denotes an SFP of an image forming apparatus (for example, a printing apparatus) according to embodiments. Reference numeral 101 denotes a printing unit. The printing unit 101 forms (prints) an image on a recording material by an electrophotographic printing approach. In other words, the printing unit 101 at least is provided with a photoconductive member (a photosensitive drum), an exposure apparatus, a developing apparatus, and a transfer apparatus. The exposure apparatus has a laser for exposure, and the laser emits a light beam (beam) towards the photosensitive drum. By this light emission, a latent image is formed on the photosensitive drum. The developing apparatus develops the formed latent image. In other words, in this development, by development material (toner) adhering to an exposed portion on the photosensitive drum, an image (toner image) is obtained. Then, by the transfer apparatus transferring the obtained toner image to a recording material in sheet form (for example, paper), an image is formed on the recording material. Reference numeral 102 denotes an image data generating unit generally referred to as a printer controller. The image data generating unit 102 receives print request data from a personal computer (PC), or the like, converts the print request data into image data, and further converts the converted image data into data (a signal) conforming to the printing unit 101. This conversion to data (a signal) conforming to the printing unit 101 is simply called image data (signal) generation. In the image forming apparatus 100, the image data generating unit 102 (printer controller) generates image data (a signal), and the printing unit 101, in accordance with that image data (signal), directly controls the light emission of the laser for exposure.

Reference numeral 103 denotes a System On Chip (SOC), which is an integrated circuit with a built-in CPU that performs, on a single chip, various control such as CPU and memory control, communication with the printing unit 101, and image data transfer. For example, the SOC 103 performs control of a USB for receiving print request data from the PC, of an external interface of a LAN, or the like.

Reference numeral 104 denotes Flash ROM for storing program code for operating the CPU built into the SOC 103, and storing data, or the like, and the program code can be changed as necessary. Reference numeral 105 denotes an SDR-SDRAM (or a DDR (1, 2, or 3)-SDRAM), which is a memory for loading the program code stored in the Flash ROM 104, for storing image data, and for storing temporary data for programs. Reference numeral 106 denotes a non-volatile memory (EEPROM) capable of holding necessary information even without a power supply of the SFP 100 being supplied.

Reference numeral 107 denotes something referred to as a PHY which is a driver receiver IC for network (LAN) data communication, and this supports transfer rates such as 10 Mbps, 100 Mbps and 1000M (1 G)bps. Reference numeral 108 denotes a LAN (network) interface connector, and is referred to as RJ45. By connecting a wired LAN cable to this connector, printing via the network becomes possible. Reference numeral 109 denotes a USB, as is commonly known, which is referred to as a USB device interface in the SFP 100, wherein a transfer speed is determined to be the USB 1.1, USB 2.0, or the like.

Reference numeral 110 denotes an SCLK (System CLOCK) which is a base clock for causing processing of the SOC 103 to operate. The SCLK enters an SSCG circuit (the spread spectrum clock oscillator circuit) existing within the SOC 103, and is used for control of the FlashROM 104, the SDR-SDRAM 105, the EEPROM 106, or the like. Also, a circuit for image generation (not shown) is controlled by a base clock output from the SCLK 110.

Reference numeral 111 denotes a Video Clock circuit (VCLK). The VCLK 111 generates a clock signal (clock) and supplies the clock signal to the SOC 103. More specifically, the VCLK 111 supplies the clock to a Phase Locked Loop circuit (PLL 2033) within the SOC 103. The PLL 2033 multiplies the supplied clock frequency (for example, 10 MHz), and supplies the multiplied clock (for example, 100 MHz) to circuits within the SOC 103 (an image output circuit 2031, the SSCG 2034). The multiplied clock is used for generating a YMCK output image signal 122 (called a Video signal or a VDO signal) output asynchronously to the printing unit 101 from the image output circuit (image outputting apparatus) within the SOC 103. Reference numeral 112 denotes a PCLK for operating the PHY 107 for the LAN, and it is common that it is 25 MHz. A UCLK 113 controls the USB-D (USB device) 109. There is a function by which it is possible to represent a status of a printing apparatus on a PC via the LAN 108, which is referred to as an RUI (remote UI). Via the remote UI, printing apparatus setting is possible.

<SOC Configuration>

Figure 2:
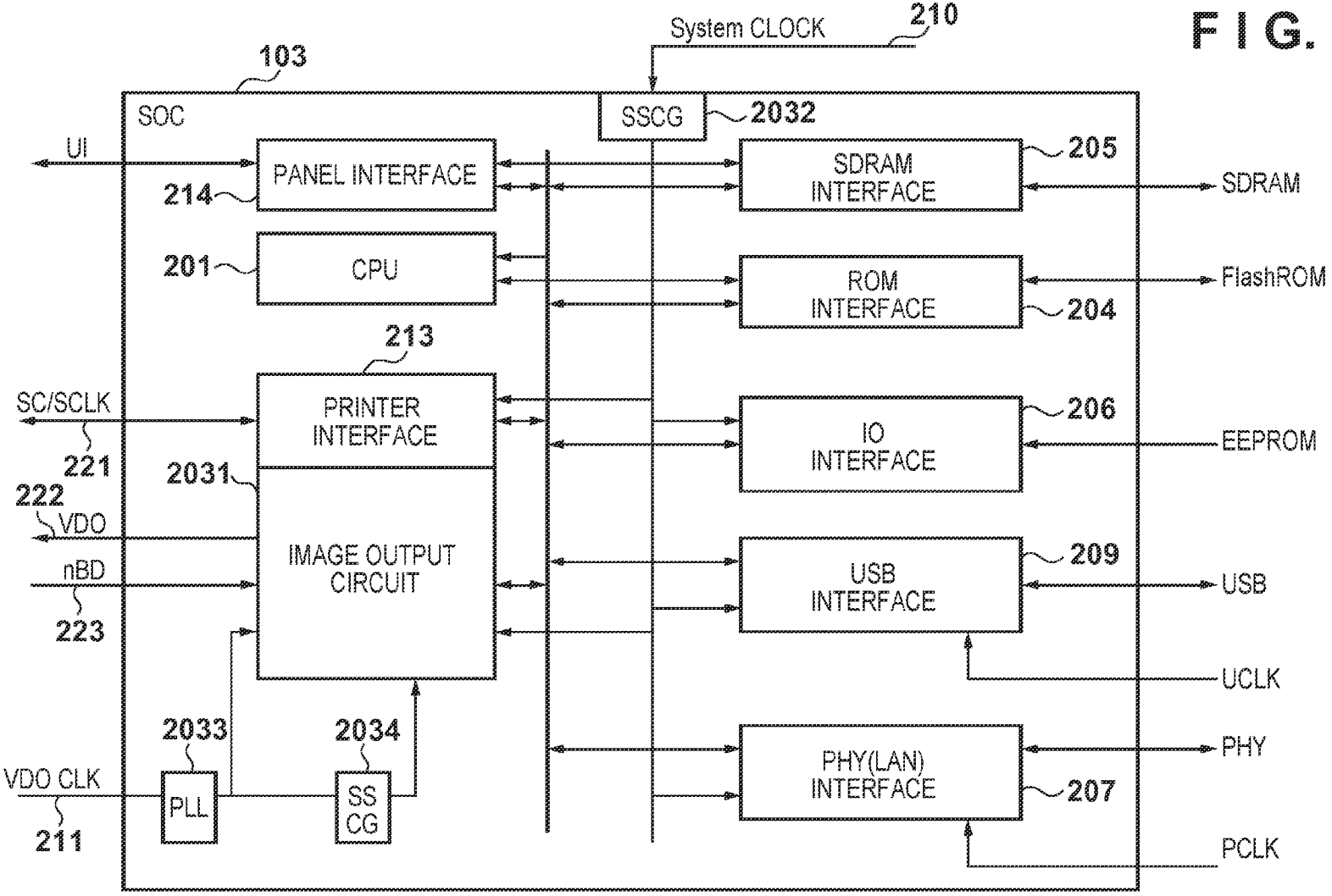
FIG. 2 is a view for showing internal blocks of an SOC 103.
Figure 3:
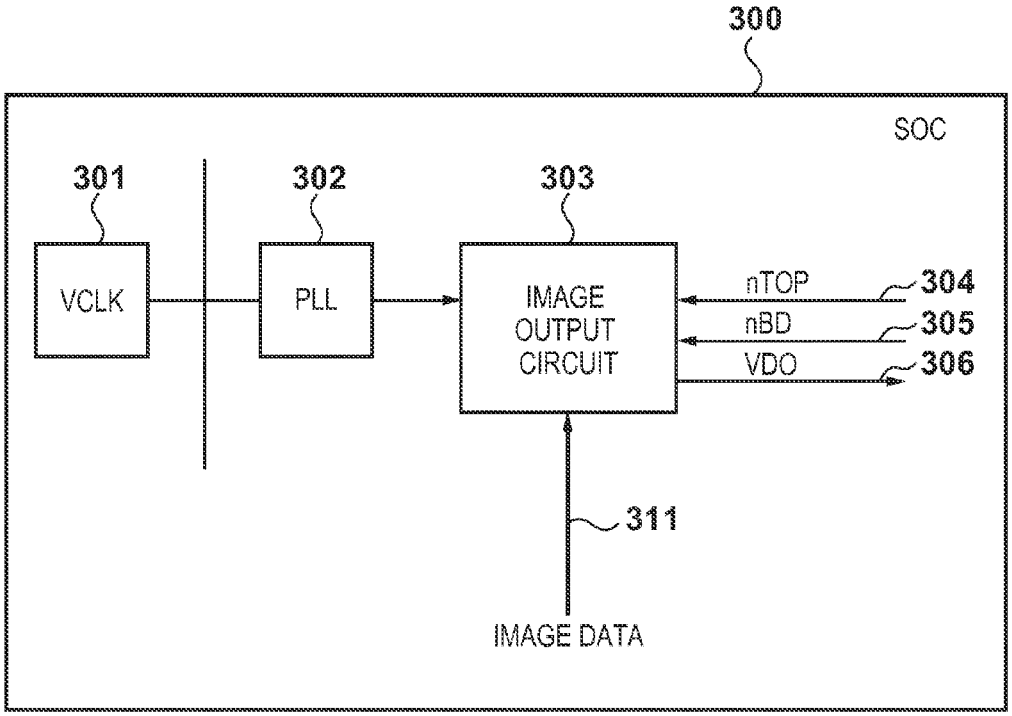
FIG. 3 is a view for showing control blocks of an SOC which is a comparative example.

Next, with reference to FIG. 2, explanation will be given for an example configuration of internal blocks of the SOC 103. Reference numeral 201 denotes a CPU for controlling the image data generating unit 102. A ROM interface 204 controls the FlashROM 104. An SDRAM interface 205 controls the SDRAM 105. An IO interface 206 controls the EEPROM 106. A PHY interface 207 is a general purpose interface such as MII, and controls the PHY 107. A USB interface 209 controls the USB-D 109.

A printer interface 213 controls the printing unit 101 by exchanging a printer interface signal (SC/SCLK) 221 with the printing unit 101. A panel interface 214 controls a UI 114. Each component is controlled by a spectral diffusion oscillation clock being input into of an SSCG 2032 block for the System CLOCK from a System CLOCK 210.

Also, regarding the PHY interface 207 and the USB interface 209, the clocks are such that the SSCG 2032 is not used to perform asynchronous transfer operation between the System CLOCK 210 and the PCLK or the UCLK, and so asynchronous data exchange is performed within the blocks. The Phase Locked Loop (PLL) 2033 raises the frequency of a VDO CLOCK signal (VCLK) 211 (equivalent to the VCLK 111) and enters the SSCG 2034 and the image output circuit 2031. The image output circuit 2031 outputs a generated image via the CPU 201 and the SDRAM interface 205, in accordance with a clock frequency of the VCLK 211, as asynchronous image data from a VDO signal 222 (equivalent to the VDO signal 122).

<Comparative Example>

Next, with reference to FIG. 3 through FIG. 6, explanation will be given for an image output method for a case where a background exposure unnecessary radiation counter-measure is not taken as a comparative example for comparison with the present invention. Firstly, with reference to FIG. 3, explanation will be given for a control block of the SOC which is a comparative example. Reference numeral 300 denotes the SOC which is the comparative example. A VCLK 301 (equivalent to the VCLK 111) is a clock for image output, and is a quartz oscillator for which a frequency is determined based on a time period for a printing unit to generate 1 dot. Alternatively, this component may be a crystal oscillator. A PLL 302 (equivalent to the PLL 2033) raises the frequency of an inputted clock, and generates a frequency for generating an image. An image output circuit 303 is a circuit for actually outputting the image to the printing unit.

Image data 311 is transferred from within the same SOC 300 to the image output circuit 303. As a VDO signal 306 (equivalent to the VDO signal 122), in synchronization with the clock generated by the PLL 302, an image is transferred by serial communication and actually irradiated onto a polygon mirror through a laser IC. Explanation will be given for the irradiation timing using FIG. 4.

Figure 4:
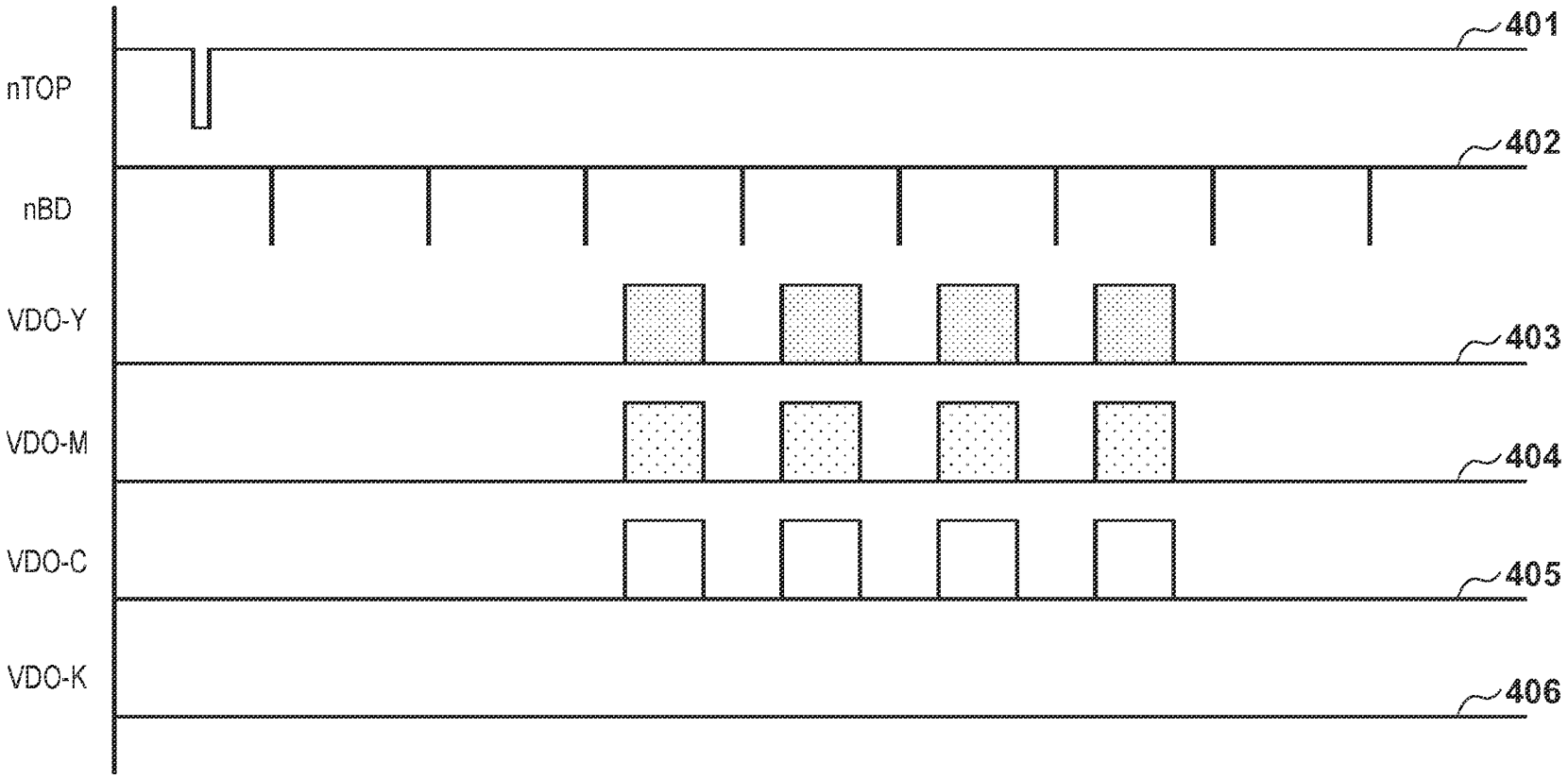
FIG. 4 is a timing chart which is a comparative example.

Reference numeral 401 denotes an nTOP signal. Reference numeral 402 denotes an nBD signal. Reference numerals 403-406 denote Y, M, C and K of the VDO image respectively. FIG. 4 shows a state in which the VDO images (YMCK) 403-406 are transferred asynchronously to the printing unit 101 in synchronization with an nBD signal 402 after the nTOP signal 401 is output. Note, the VDO images 403-406 are equivalent to the VDO signal 122.

Figure 5:
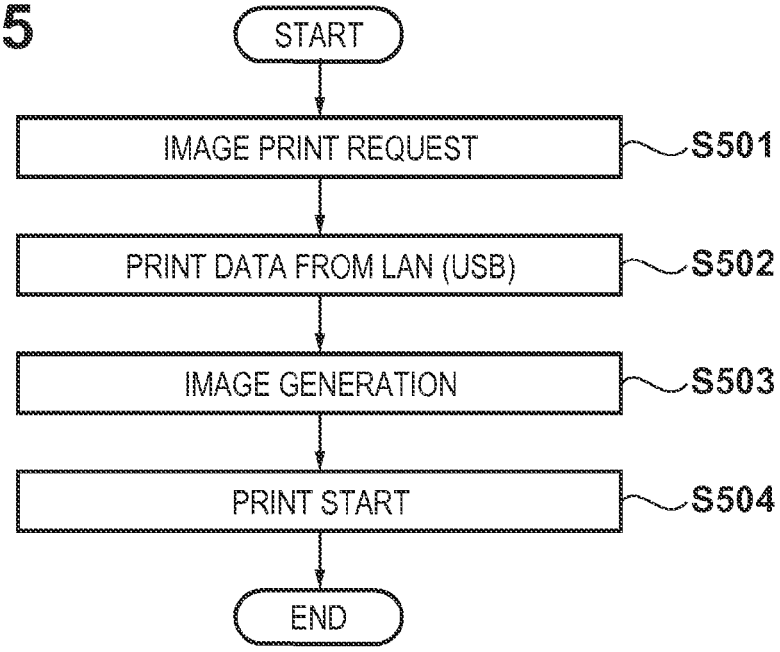
FIG. 5 is a flowchart for when a normal print is performed.

Next, with reference to FIG. 5, explanation will be given for a normal print procedure in a case where print data is obtained from the LAN and printing is executed. In step S501, the SOC 300 receives, via the LAN, an image print request, and receives print data via the LAN in step S502. Continuing on, in step S503, the SOC 300 generates an image internally. In step S504, the SOC 300 starts printing, and when the printing completes, the process is terminated.

Figure 6:
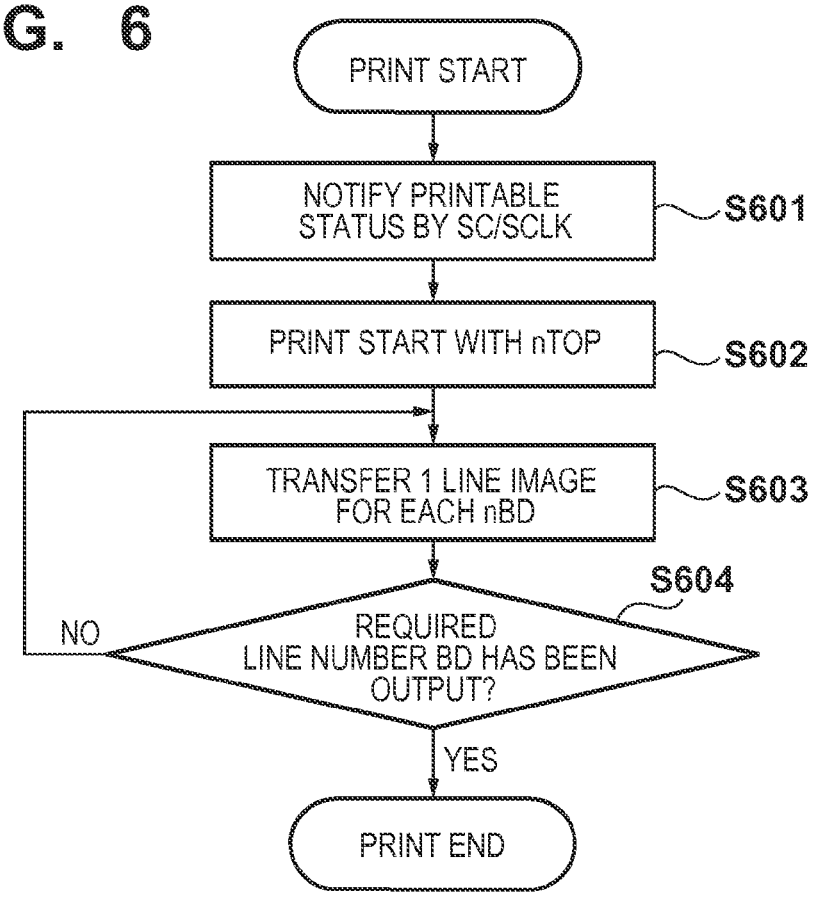
FIG. 6 is a detailed flowchart for when a normal print is performed.

Next, with reference to FIG. 6, explanation will be given for a processing procedure corresponding to the timing chart of FIG. 4. In step S601, the SOC 300 notifies the printing unit of a printable status by SC/SCLK. In step S602, the SOC 300 receives an nTOP signal which is a print request made by the printing unit, and starts the printing. In step S603, the SOC 300 outputs YMCK (Yellow, Magenta, Cyan, Black) VDO signals to the printer control unit for each nBD signal. In step S604, the SOC 300 determines whether or not a required number of lines BD has been output. Because the number of times that the nBD signal is output is determined depending on the image size, when a predetermined number of times terminate, the printing terminates. With this, the printing of 1 page terminates.

<Control Block>

Next, with reference to FIG. 7, explanation will be given for a control block of the SOC 103 according to embodiments. With respect to the comparative example of FIG. 3, the SSCG 2034 and the image output circuit 2031 are different. Regarding the image output circuit 2031, a circuit actually exists for each of the 4 colors YMCK. Reference numeral 7031 denotes a circuit for image output for Y, and is configured to internally include a conventional image output circuit 7041 and an image output circuit 7042 for a microscopic light emission pulse upon a background exposure. Images output from the image output circuit 7041 and the image output circuit 7042 are output as a VDO signal 7044 (equivalent to the VDO signal 122) by an OR circuit 7043.

More specifically, the image output circuit 7042 operates on a clock for which the frequency changes for every time period by a spectral diffusion technique of the SSCG 2034 for a clock frequency multiplied by the PLL 2033 of the Video CLOCK output from the VCLK 111. The image output circuit 7042 outputs a microscopic light emission pulse corresponding to an image for a background exposure (for example, a video signal corresponding to image data of a background of a character or a graphic) to the OR circuit 7043. Meanwhile, the image output circuit 7041 operates on a clock to which the SSCG 2034 is not applied, and outputs a pulse signal corresponding to a normal image (for example, a video signal corresponding to character or graphic image data) to the OR circuit 7043. The OR circuit 7043 performs a logical operation (OR) on the input from the image output circuits 7041 and 7042 and outputs the result as the VDO signal 7044. Note, each of the YMCK planes is of the same circuit arrangement.

<Timing Chart>

Next, with reference to FIG. 8, explanation will be given for the timing chart in the circuit arrangement of FIG. 7. Here, only the timing for Yellow is recited, but it is the same for the other colors. Reference numeral 801 denotes an nBD signal. Reference numerals 802-804 denote VDO signals.

The VDO1 (Y) 802 indicates a situation in which an image of 12 dots is output from the image output circuit (Y) 7031. Note, explanation is given having 1 dot correspond to a single pixel. The VDO2 (Y) 803 shows a situation in which image data of a width of ⅛ dot interval (in other words, image data for a microscopic light emission corresponding to an exposure amount of an extent at which the toner actually does not adhere to the photosensitive drum) is periodically output from the image output circuit 7042. Here, for the image of the VDO2 (Y) 7046 output from the image output circuit 7042, the image width, the SSCG rate, and the interval of periodic output are changed depending upon the type of the printer.

The VDO (Y) 804 indicates a signal actually output as the VDO signal 222 from the OR circuit 7043, and the VDO (Y) 804 is output to the printing unit 101 as is. As illustrated in FIG. 8, the logical OR signal (OR) of the VDO1 (Y) 7045 and the VDO2 (Y) 7046 is output.

<Processing Procedure>

Figure 9:
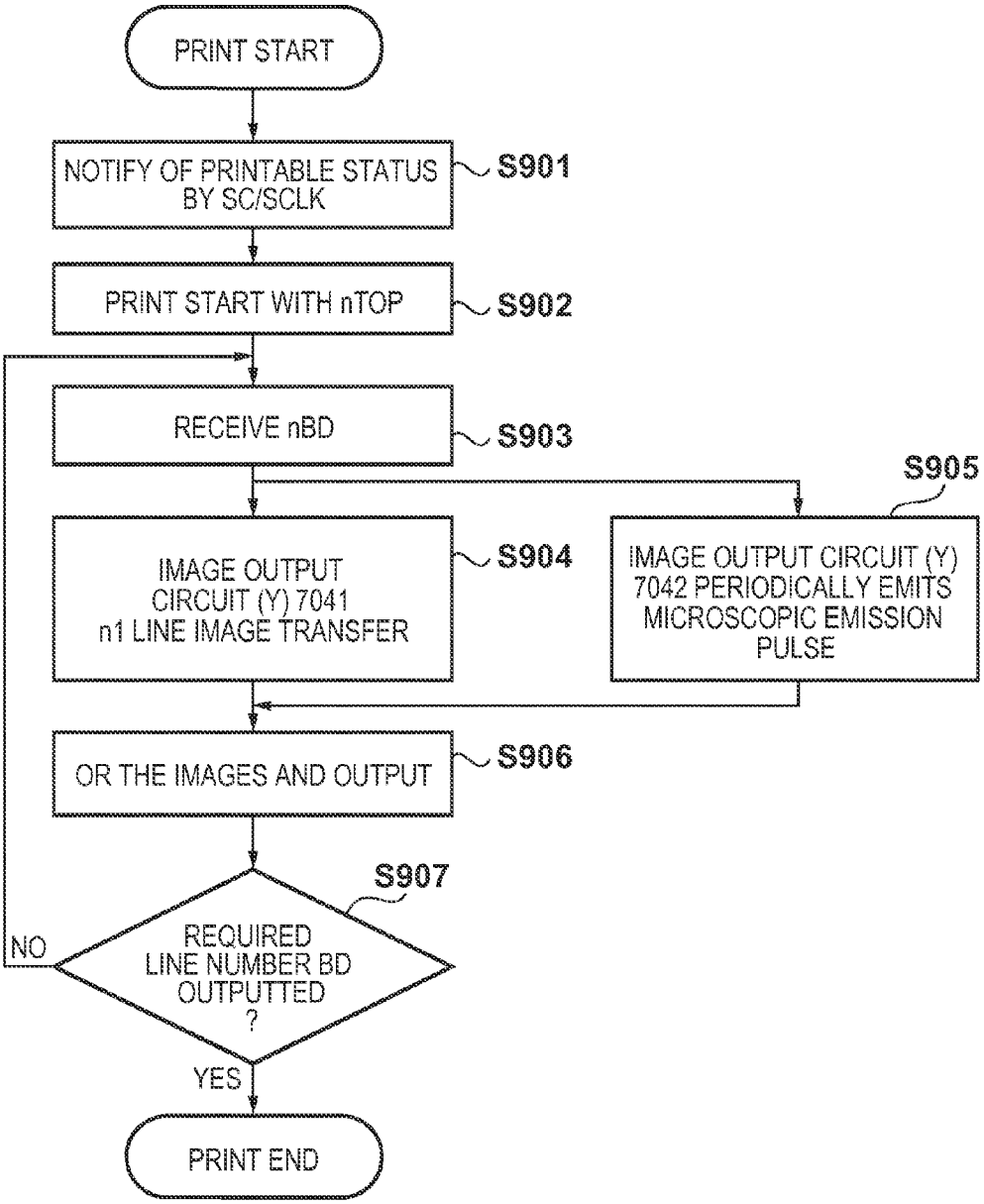
FIG. 9 is a flowchart for showing a processing procedure in a background exposure unnecessary radiation counter-measure according to embodiments.

Next, with reference to FIG. 9, explanation will be given for a processing procedure upon printing processing in embodiments. The processing explained below is performed by the SOC 103 (CPU 201) reading out a control program stored in memory, and executing it.

In step S901, the SOC 103 notifies the printing unit 101 of a printable status by SC/SCLK. In step S902, the SOC 103 receives an nTOP signal which is a print request made by the printing unit 101, and starts the printing. In step S903, the SOC 103 receives an nBD signal, and for every reception, the image output circuit (Y) 7041, in step S904, reads in an image, and transfers an image of 1 line. In parallel to this, the image output circuit (Y) 7042, in step S905, issues a microscopic light emission pulse as the VDO2 (Y) 7046 at an interval and a pulse width in accordance with a register value (not shown) existing within the SOC 103.

After this, in step S906, the SOC 103 outputs a calculation result as the VDO (Y) 7044 with of each image as an operator of a logical OR. In step S907, determination is made whether or not the required number of lines BD are output, and when nBD issuances have terminated, the process is terminated.

As explained above, by virtue of the present embodiment, unnecessary radiation can be avoided in a case where a background exposure is performed by a printer controller. Also, it is possible to control with the CPU 201 a pulse width of the microscopic light emission and an interval of issuance.

<First Variation>

Figure 10:
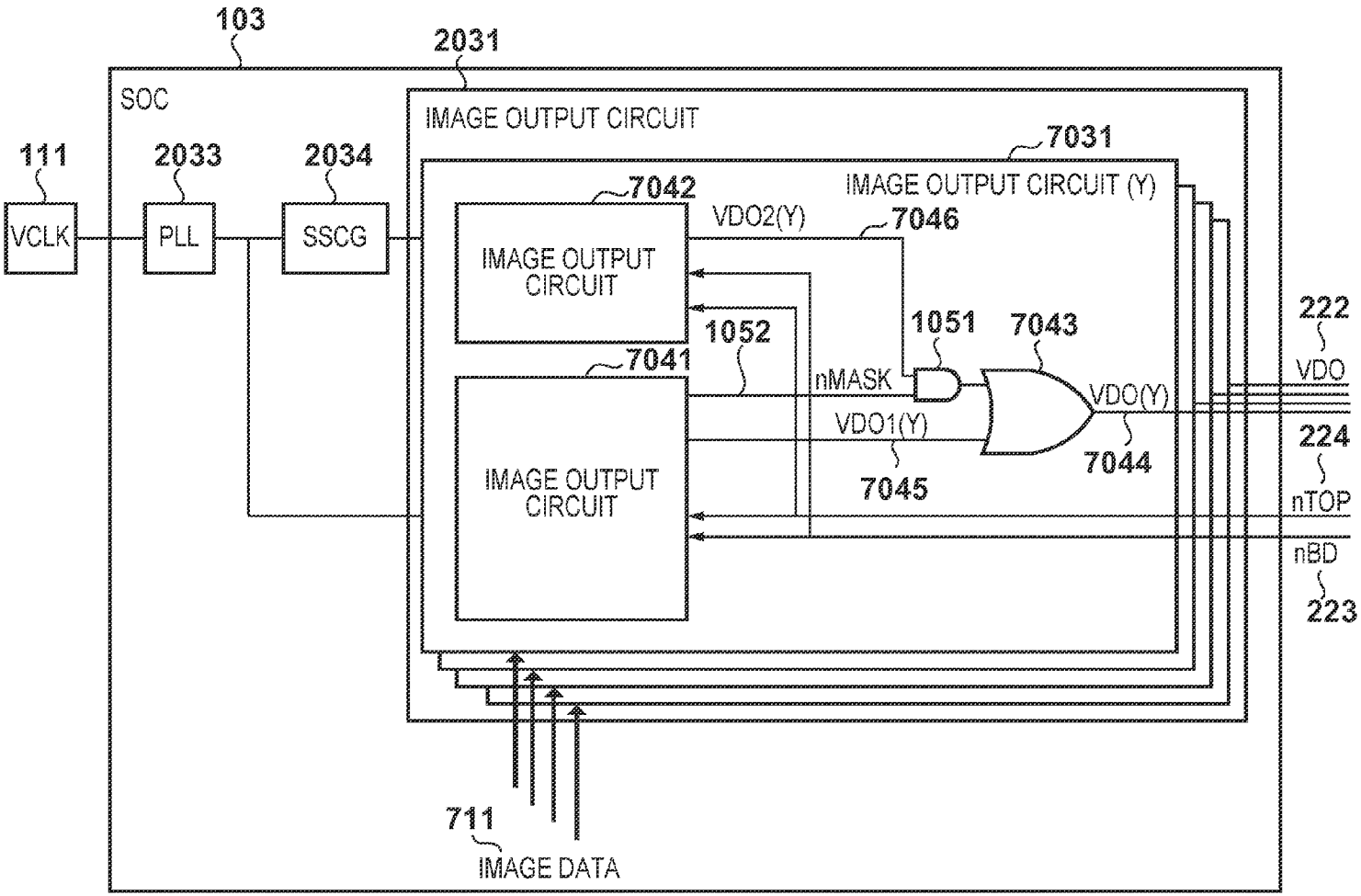
FIG. 10 is a view for showing a control block of the SOC 103 according to a first variation of embodiments.

In the embodiments described above, in the configuration of FIG. 7, because color is determined dividing into 1 dot widths in a case of a color image, there is the possibility that a tint will change. For example, even when there is no problem with a setting A in a printer A, there is a possibility that an image-related problem will arise in a printer B of a differing printer type. With reference to FIG. 10, explanation will be given for a circuit configuration for preventing a change in tint even when the type of the printer is changed. Here, explanation will be given mainly for differences with the configuration of FIG. 7.

As illustrated in FIG. 10, in a case where the VDO1 (Y) signal is output in a 1 dot section and the image output circuit 7042 outputs the VDO2 (Y) in 1 dot units, the image output circuit 7041 issues an nMASK signal (mask signal) 1052 towards the output of the image output circuit 7042. This signal is normally H (High), but in a case where the VDO2 (Y) signal is not desired to be output, this signal is made to be L (Low), and a mask is applied by using an AND circuit 1051 with 1052 so that the VDO2 (Y) signal is not output. That is, the VDO2 (Y) signal from the image output circuit 7042 and the nMASK signal are input into the AND circuit 1051, and the calculation result (logical AND) is input into the OR circuit 7043.

Figure 7:
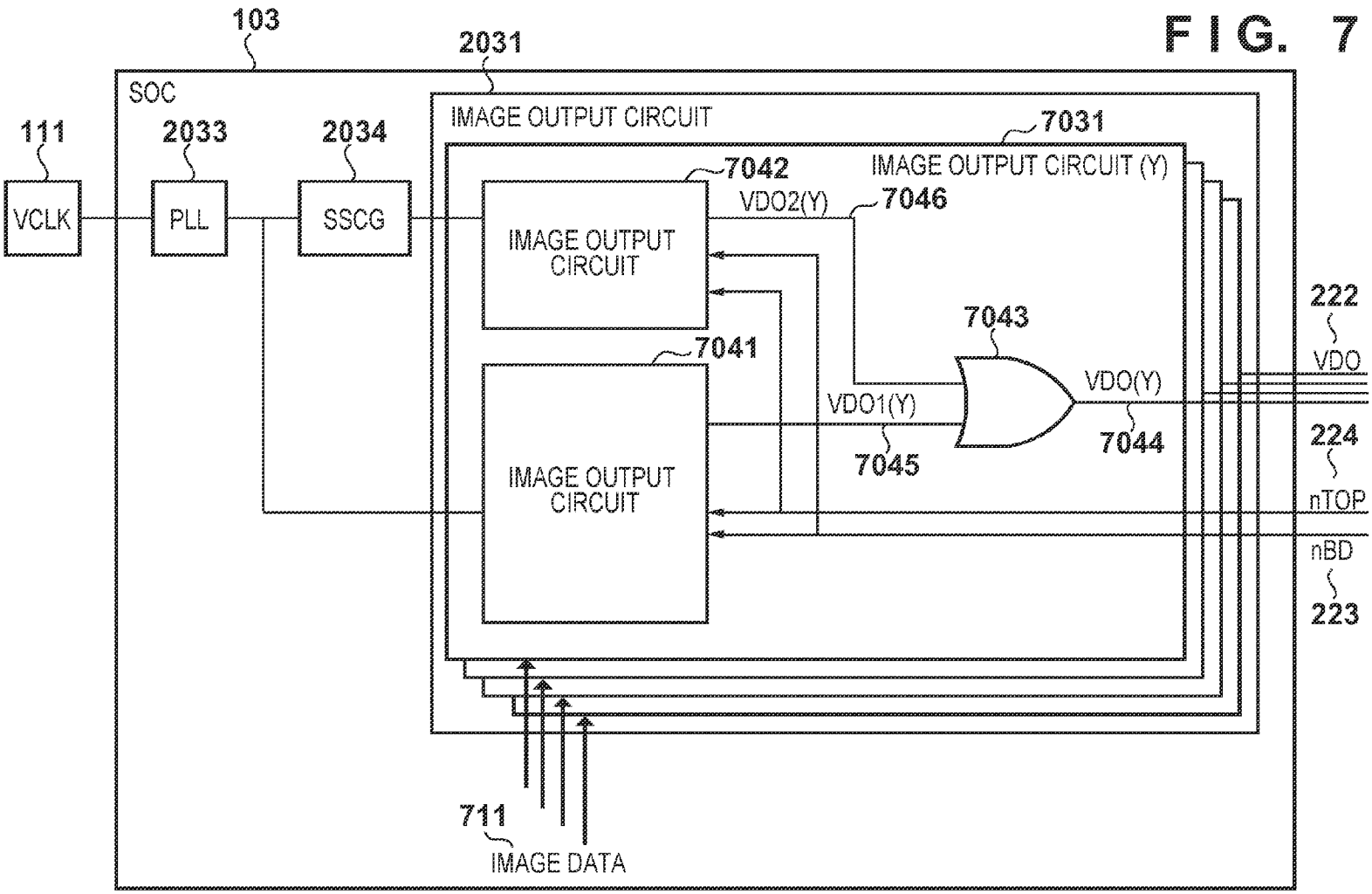
FIG. 7 is a view for showing a control block of the SOC 103 according to embodiments.
Figure 8:
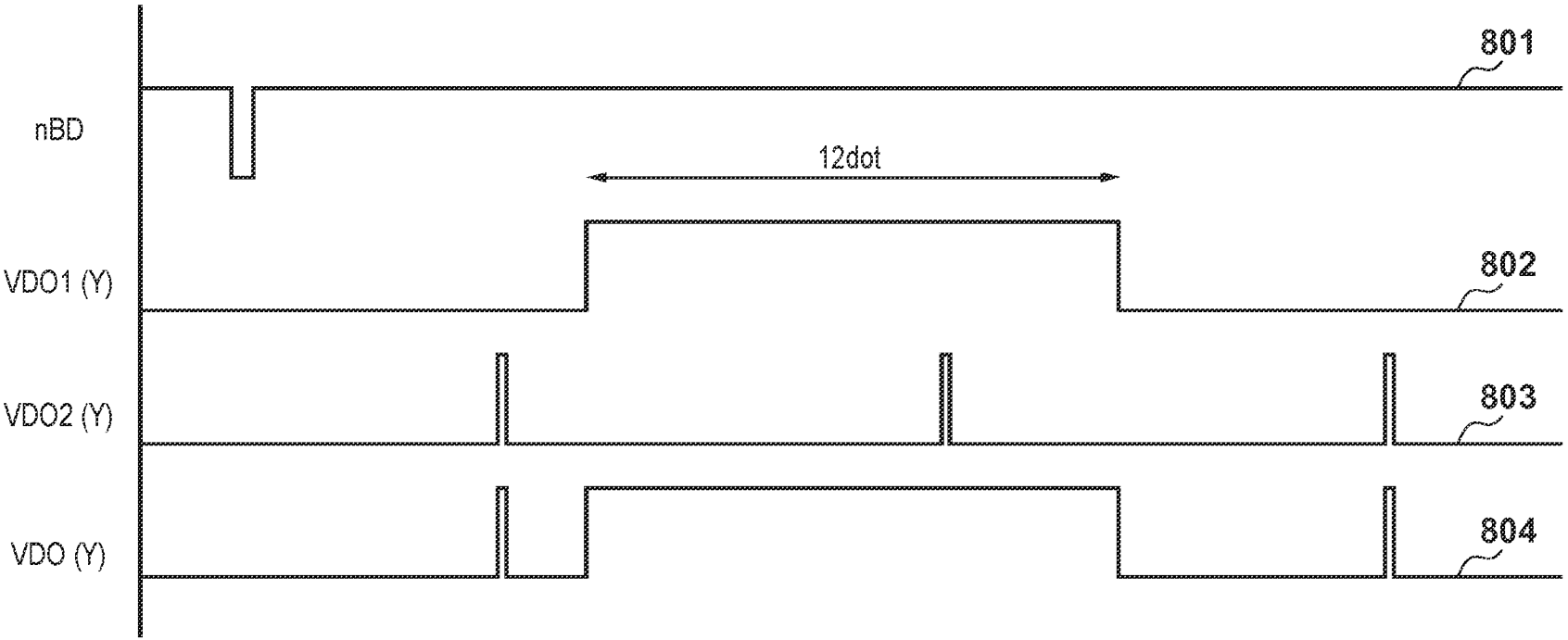
FIG. 8 is a timing chart in a background exposure unnecessary radiation counter-measure according to embodiments.
Figure 11:
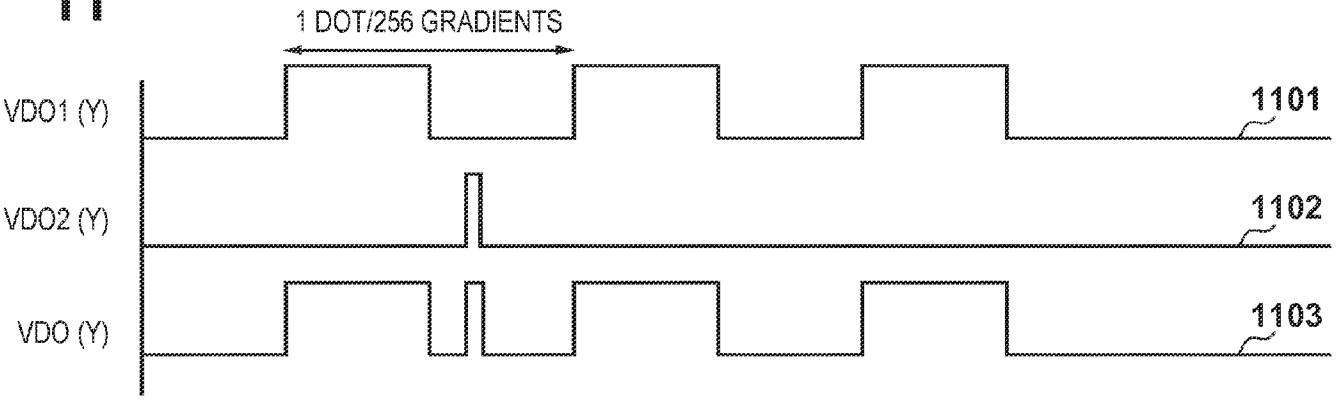
FIG. 11 is a timing chart in a background exposure unnecessary radiation counter-measure.
Figure 12:
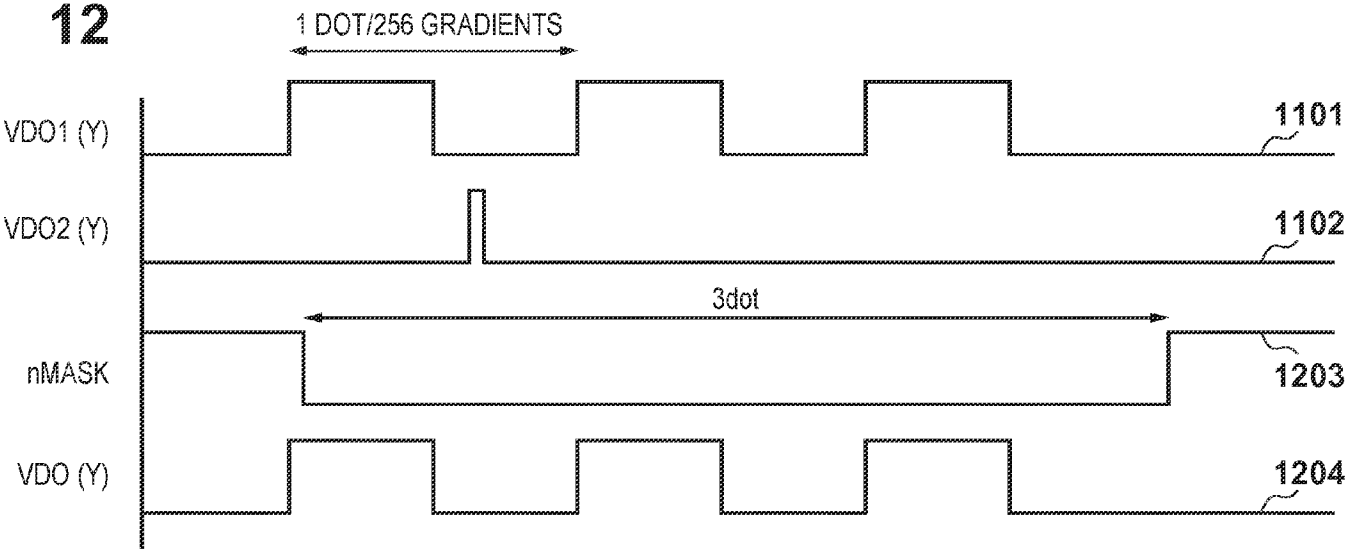
FIG. 12 is a timing chart in a case in which a problem of FIG. 7 is avoided according to the first variation of embodiments.

FIG. 11 shows a timing chart for the case of the circuit configuration of FIG. 7, and FIG. 12 shows a timing chart for the case of the circuit configuration of FIG. 10. Reference numerals 1101 and 1102 denote the VDO1 (Y) signal and the VDO2 (Y) signal respectively. Reference numerals 1103 and 1204 denote the VDO (Y) signal in the circuit configurations of FIG. 7 and FIG. 10. Reference numeral 1203 denotes an nMASK signal.

In the case of a color image, a 1 dot section is not necessarily Active. For example, as illustrated in FIG. 11, there is the possibility that a microscopic light emission pulse overlaps in a case where, when a simple OR circuit is employed as in FIG. 7, not all of a color Y image 1 dot section is set to H.

However, because there will be the possibility that the tint will change because of this, the VDO2 (Y) microscopic light emission pulse is masked during image output. As illustrated in FIG. 12, when the nMask circuit is set to L in synchronization with the normal image from the image output circuit 7041, the image of the VDO2 (Y) is masked, and only the normal image is issued for that segment. Here, the image output circuit 7041, in a case where outputting of the image data is performed in at least a portion of a 1 dot section, the nMASK signal is output in all of that 1 dot section. With this, it is possible to mask the microscopic light emission pulse from the image output circuit 7042 issued within that 1 dot section.

Figure 13:
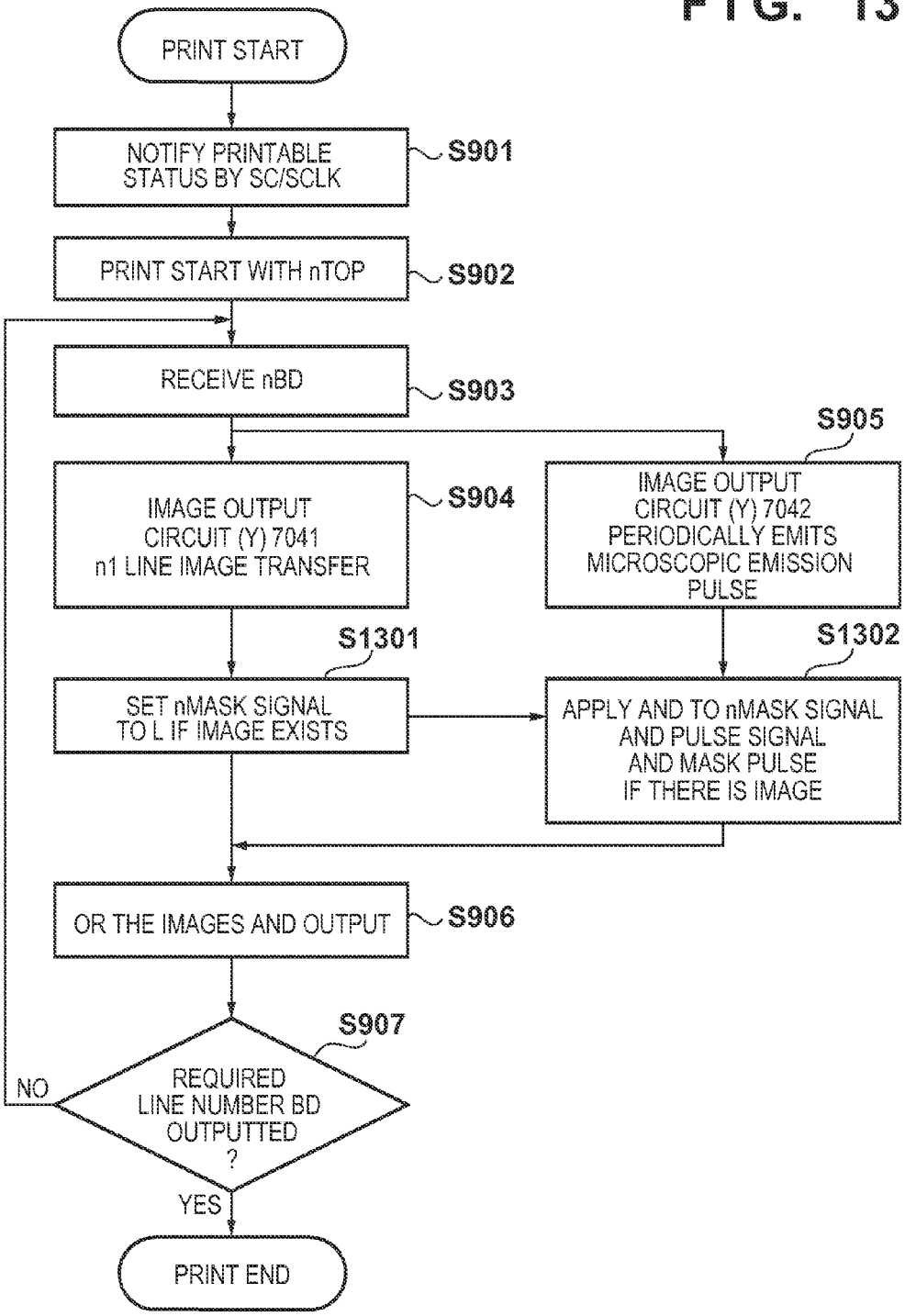
FIG. 13 is a flowchart for showing a processing procedure in a background exposure unnecessary radiation counter-measure according to the first variation of embodiments.

Continuing on, with reference to FIG. 13 explanation will be given for a processing procedure. Here, explanation will be given for differences with the flowchart of FIG. 9. Compared to the flowchart of FIG. 9, step S1301 and step S1302 are added.

When step S904 terminates, the image output circuit 7041, in step S1301, outputs FF for the image data in a 1 dot image in a case where an image exists, and an inverted data nMASK signal is set to L. In other words, in the example of FIG. 12, the nMASK signal is set to L during the output of 3 dots of image data. When step S1301 or step S905 terminates, the processing proceeds to step S1302, and the image output circuit 2031 calculates a logical AND of the VDO2 signal issued from the image output circuit 7042, and the nMASK signal, and when there is an image, the microscopic light emission pulse is masked. After this, the processing proceeds to step S906, and the image output circuit 2031 calculates and outputs a logical OR. In this way, it becomes possible to suppress the tint changing by suppressing the output of the microscopic light emission pulse during image data output.

<Second Variation>

Figure 14:
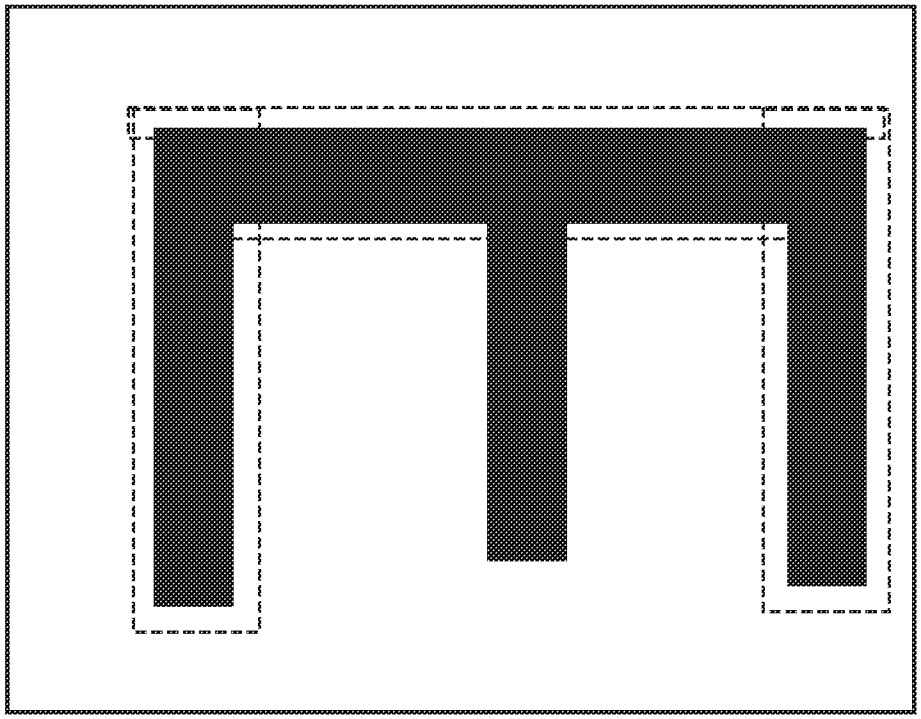
FIG. 14 is an image view representing a slip of an image.

There is the possibility that a slip will occur in a case where a microscopic light emission comes at a location of an image surrounded by peripheral dashed lines as shown in FIG. 14 with the circuit configuration of FIG. 7 or FIG. 10. There is also the possibility that when a microscopic light emission comes at a peripheral dashed line portion of the character E of FIG. 14, i.e. in pixels around a pixel of interest, toner will adhere and the image will slip.

Figure 15:
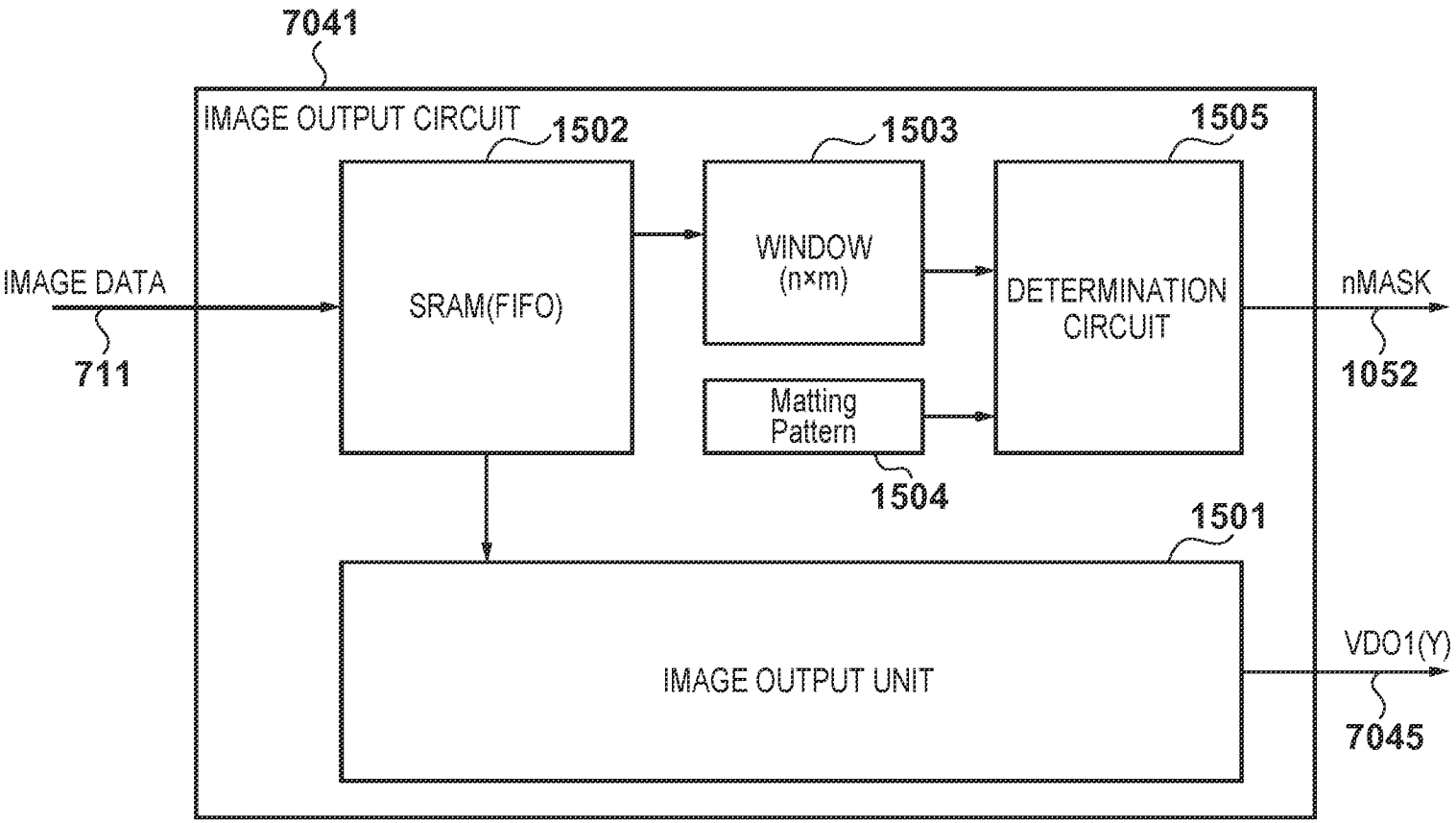
FIG. 15 is a view for showing a control block of the SOC 103 according to a second variation of embodiments.

Below, with reference to FIG. 15, explanation will be given for a circuit configuration in which even when microscopic light emission data exists in the periphery of an image, it is not output. The block configuration is the same as FIG. 10, but an image periphery slip can be avoided by setting so to not output the microscopic light emission pulse not only in the main-scanning direction but also in the sub-scanning direction by changing the nMASK signal issuance timing.

An image output unit 1501 of the image output circuit 7041 outputs the VDO1 (Y) signal, which is image data. Reference numeral 1502 denotes an SRAM or a FIFO (memory) capable of holding at least 3 lines of image data. Reference numeral 1503 denotes a pixel WINDOW, into which n dots by m lines of pixels are received from the SRAM. With respect to a pixel of interest, by determining whether a pixel is positioned within a predetermined range in an up-down orientation, and a left-right orientation (several dots), and controlling the nMask with a predetermined matching pattern 1504 and a determination circuit 1505, it is determined whether a background exposure image is output at a peripheral pixel in the main-scanning direction and the sub-scanning direction from the pixel of interest. With this kind of approach, an image slip can be avoided by configuring so that the microscopic light emission is not performed on a periphery at which an image exists.

Figure 16:
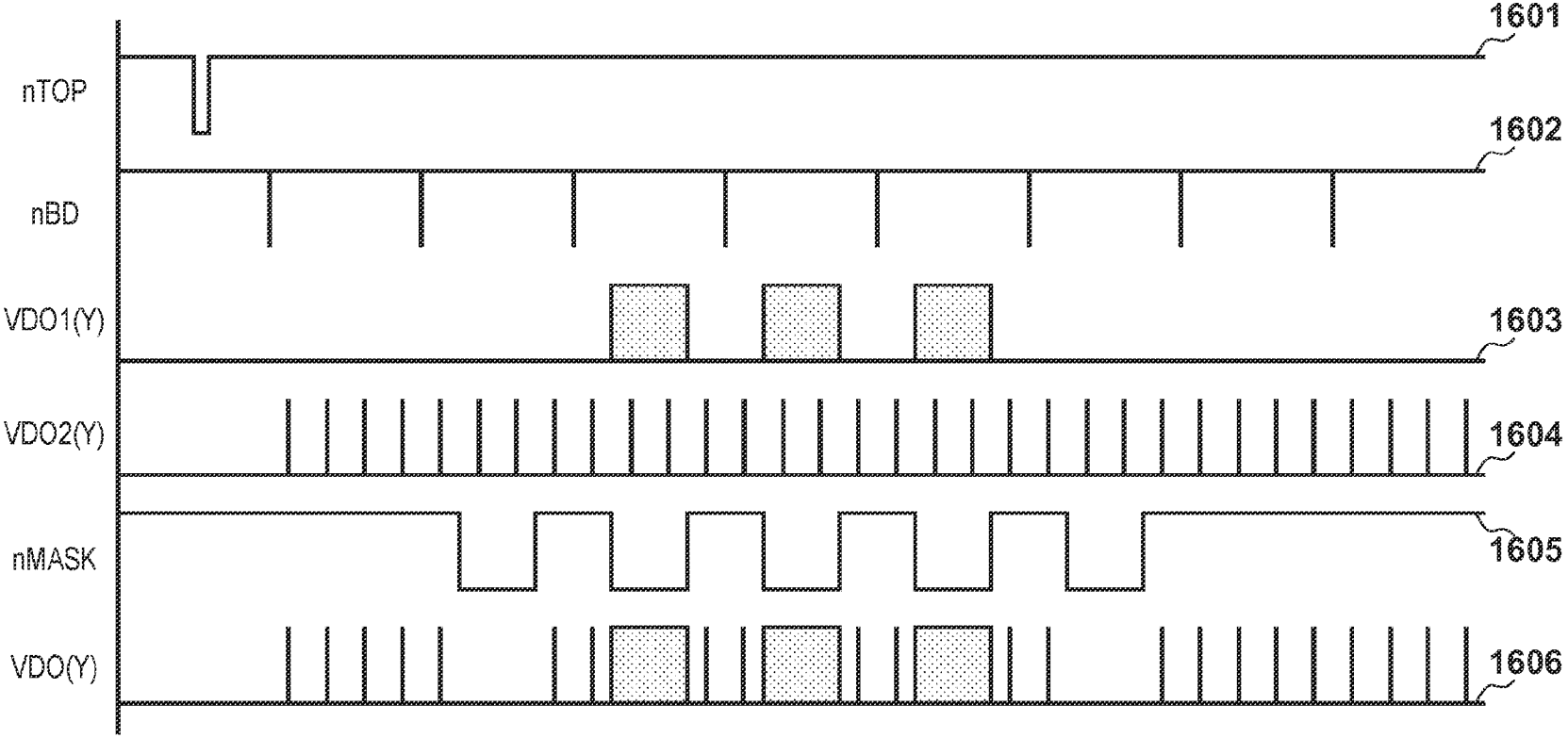
FIG. 16 is a timing chart according to the second variation of embodiments.

With reference to FIG. 16, explanation will be given for a timing chart in this variation. Reference numeral 1601 denotes an nTOP signal. Reference numeral 1602 denotes an nBD signal. Reference numeral 1602 denotes a VDO1 (Y) signal. Reference numeral 1604 denotes a VDO2 (Y) signal. Reference numeral 1605 denotes an nMASK signal. Reference numeral 1606 denotes a VDO (Y) signal into which a logical OR is calculated.

By setting the nMASK signal to L on an image area 1 line above, or an image area 1 line below, at which an image exists based on existence or absence of data from the SRAM, even when an image does not exist at the current line, it is possible to mask output from the VDO2 signal. Note, the same is true for the several dots before and after in the main-scanning direction at which an image exists. By the above approach, a slip in a peripheral portion of an image can be avoided.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-214137 filed on Oct. 11, 2013, which is hereby incorporated by reference herein in its entirety.

What is claimed is:

1. An image forming apparatus, comprising:

a clock output circuit configured to output a clock signal which is used for outputting a video signal;

a first image output circuit configured to output a first video signal in accordance with the outputted clock signal and a mask signal masking an output from another image output circuit;

a second image output circuit configured to output a second video signal in accordance with a clock signal which is generated from the outputted clock signal by a spread spectrum clock generator;

an AND circuit configured to calculate a logical AND of the mask signal output from the first image output circuit and the second video signal output from the second image output circuit, and to output a third video signal which is the calculation result of the logical AND; and an OR circuit configured to calculate a logical OR of the first video signal output from the first image output circuit and the third video signal output from the AND circuit, and to output, to an image forming unit, a fourth video signal which is the calculation result of the logical OR, wherein a laser device provided in the image forming unit is controlled in accordance with the fourth video signal output from the OR circuit.

2. The image forming apparatus according to claim 1, wherein the first video signal corresponds to image data of at least a character or a graphic, and the second video signal corresponds to image data of a background of at least the character or the graphic.

3. The image forming apparatus according to claim 1 wherein the second video signal corresponds to image data for a microscopic light emission of the laser device.

4. The image forming apparatus according to claim 3 wherein, in a development, the laser device emits, to a photoconductive member, in accordance with the image data for the microscopic light emission, a light of an amount of an extent at which a toner does not adhere to the photoconductive member.

5. The image forming apparatus according to claim 1, wherein the first image output circuit masks the output from the second image output circuit by outputting, in a case where outputting of image data is performed in at least a portion of a 1 dot section, an nMASK signal in all of that 1 dot section.

6. The image forming apparatus according to claim 1, wherein the first image output circuit outputs the mask signal in a peripheral pixel of an image to be formed.

7. The image forming apparatus according to claim 6, wherein the peripheral pixel includes a pixel positioned within a range up until predetermined pixel in a main-scanning direction and in a sub-scanning direction from a pixel of interest.

8. The image forming apparatus according to claim 7, wherein the first image output circuit comprises a memory for holding image data of at least 3 lines.

9. The image forming apparatus according to claim 1, wherein the clock output circuit is a phase locked loop circuit.

10. An image output circuit for processing and outputting input image data, the image output circuit comprising:

a first image output circuit configured to output a first video signal and a mask signal masking an output from another image output circuit, in accordance with a clock signal for outputting an image;

a second image output circuit configured to output a second video signal for a microscopic light emission, in accordance with a clock signal for which the clock signal is caused to change by a spread spectrum clock generator;

an AND circuit configured to calculate a logical AND of the mask signal output from the first image output circuit and the second video signal output from the second image output circuit, and to output a third video signal which is the calculation of the logical AND; and an OR circuit configured to calculate a logical OR of the first video signal output from the first image output circuit and the third video signal output from the AND circuit, and to output a fourth video signal which is the calculation result of the logical OR.

11. A method of controlling an image forming apparatus, the method comprising:

a clock output step of outputting a clock signal used for outputting a video signal;

a first image output step of outputting a first video signal in accordance with the outputted clock signal;

a mask signal output step of outputting a mask signal masking a second video signal;

a second image output step of outputting the second video signal in accordance with a clock signal for which the outputted clock signal is caused to change by a spread spectrum clock generator;

an AND step of calculating a logical AND of the mask signal output by the mask signal output step and the second video signal output by the second image output step, and outputting a third video signal which is the calculation result of the logical AND; and an OR step of calculating a logical OR of the first video signal output by the first image output step and the third video signal output by the AND step, and outputting a fourth video signal, which is the calculation result of the logical OR, to an image forming unit, wherein a laser device provided in the image forming unit is controlled in accordance with the fourth video signal output by the OR step.

* * * * *